US006176087B1

(12) United States Patent
Snyder et al.

(10) Patent No.: US 6,176,087 B1
(45) Date of Patent: Jan. 23, 2001

(54) BLUFF BODY PREMIXING FUEL INJECTOR AND METHOD FOR PREMIXING FUEL AND AIR

(75) Inventors: Timothy S. Snyder, Glastonbury; William A. Sowa, Simsbury, both of CT (US); Stephen A. Morford, Jupiter; Kevin J. Van Dyke, Palm Beach Gardens, both of FL (US)

(73) Assignee: United Technologies Corporation, Hartford, CT (US)

( * ) Notice: Under 35 U.S.C. 154(b), the term of this patent shall be extended for 0 days.

(21) Appl. No.: 08/991,032

(22) Filed: Dec. 15, 1997

(51) Int. Cl.[7] ..... F02C 7/20
(52) U.S. Cl. ..... 60/737; 60/748; 239/403
(58) Field of Search ..... 60/740, 748, 737, 60/39.06; 239/400, 403

(56) References Cited

U.S. PATENT DOCUMENTS 4,426,841 1/1984 Cornelius et al. ..... 60/39.23

(List continued on next page.)

FOREIGN PATENT DOCUMENTS 0 433 790 A1 7/1990 (EP) ..... F23D/17/00
0 849 530 A2 6/1998 (EP) ..... F23C/7/00

OTHER PUBLICATIONS

"Acoustic Sensitivities Of Lean–Premixed Fuel Injectors In A Single Nozzle Rig", Donald W. Kendrick, Torger J. Anderson, William A. Sowa and Timothy S. Snyder; prospective publication date is Jun. 2, 1998.

* cited by examiner

*Primary Examiner*—Ted Kim
(74) *Attorney, Agent, or Firm*—Kenneth C. Baran

(57) ABSTRACT

A tangential entry premixing fuel injector (10) for a gas turbine engine combustor includes a pair of offset scrolls (18) whose ends define a pair of entry slots (36) for admitting primary combustion air tangentially into a mixing chamber (28) bounded by the scrolls (18) and by longitudinally spaced endplates (14, 16). An array of fuel injection passages (42) extends along the length of the slots. The passage array is configured to inject a primary fuel nonuniformly along the length of the air entry slots and to control the fuel penetration depth d in proportion to slot height H. The injector also includes a flame disgorging centerbody (48) having a bluff tip (54) longitudinally aligned with the injector's discharge plane (22) and a secondary fuel conduit (80) extending through the centerbody for discharging a secondary combustible fluid, preferably gaseous fuel, through a series of fuel discharge openings (84) in the tip (54). The flame disgorging centerbody improves fuel injector durability by resisting ingestion of combustion flame into the mixing chamber (28) and reliably disgorging any flame that is ingested. The controlled fuel penetration depth reinforces the flame disgorging capability of the centerbody by preventing fuel from -penetrating into the slowly moving boundary layer attached to the centerbody (48). The bluff character of the centerbody, in combination with its longitudinal alignment with the fuel injector discharge plane, makes the centerbody capable of anchoring the flame at the discharge plane so that combustion occurs aft of the discharge plane where the combustion flame is unlikely to damage the scrolls or centerbody. Introduction of fuel or fuel and air through the openings in the bluff tip encourage the flame to become anchored to the tip and therefore spatially stabilizes the flame, resulting in additional attenuation of acoustic oscillations and further improved combustor durability. The longitudinally nonuniform injection of primary fuel compensates for any mixing nonuniformities attributable to the flame disgorging centerbody and therefore augments flame stability. The injector and an associated method of premixing fuel and air prior to combustion suppress formation of nitrous oxides, and improve the durability of both the injector and he combustor.

18 Claims, 4 Drawing Sheets

U.S. PATENT DOCUMENTS

| | | | | |
|---|---|---|---|---|
| 4,587,809 | | 5/1986 | Ohmori et al. | 60/737 |
| 4,781,030 | | 11/1988 | Hellat et al. | 60/743 |
| 4,931,012 | | 6/1990 | Prudhon | 431/9 |
| 4,932,861 | | 6/1990 | Keller et al. | 431/8 |
| 5,000,679 | | 3/1991 | Fukuda et al. | 431/351 |
| 5,101,633 | | 4/1992 | Keller et al. | 60/737 |
| 5,154,059 | | 10/1992 | Keller | 60/737 |
| 5,169,302 | | 12/1992 | Keller | 431/173 |
| 5,307,634 | | 5/1994 | Hu | 60/737 |
| 5,375,995 | | 12/1994 | Dobbeling et al. | 431/8 |
| 5,402,633 | | 4/1995 | Hu | 60/39.06 |
| 5,450,725 | * | 9/1995 | Takahara et al. | 60/737 |
| 5,461,865 | | 10/1995 | Snyder et al. | 60/737 |
| 5,467,926 | * | 11/1995 | Idleman et al. | 239/132.5 |
| 5,479,773 | | 1/1996 | McCoomb et al. | 60/39.32 |
| 5,482,457 | | 1/1996 | Aigner et al. | 431/350 |
| 5,564,271 | | 10/1996 | Butler et al. | 60/39.31 |
| 5,588,824 | * | 12/1996 | McMillan | 431/285 |
| 5,613,363 | | 3/1997 | Joshi et al. | 60/737 |
| 5,671,597 | * | 9/1997 | Butler et al. | 60/39.31 |
| 5,699,667 | * | 12/1997 | Joos | 60/737 |
| 5,738,509 | * | 4/1998 | Marling et al. | 431/352 |
| 5,791,562 | | 8/1998 | Kramer et al. | 239/399 |
| 5,865,609 | * | 2/1999 | Sowa et al. | 431/9 |
| 5,887,795 | * | 3/1999 | Sowa et al. | 239/405 |
| 5,896,739 | * | 4/1999 | Snyder et al. | 60/39.06 |
| 5,899,076 | * | 5/1999 | Snyder et al. | 60/740 |

BLUFF BODY PREMIXING FUEL INJECTOR AND METHOD FOR PREMIXING FUEL AND AIR

CROSS REFERENCE TO RELATED APPLICATIONS

This application contains subject matter related to commonly owned U.S. patent application Ser. No. 08/771,408 entitled "Flame Disgorging Two Stream Tangential Entry Nozzle" filed on Dec. 20, 1996, now U.S. Pat. No. 5,899,076 and commonly owned patent application Ser. No. 08/771,409 entitled "Method of Disgorging Flames from a Two Stream Tangential Entry Nozzle" filed on Dec. 20, 1996, now U.S. Pat. No. 5,896,739.

TECHNICAL FIELD

This invention relates to premixing fuel injectors for gas turbine engines, and to methods of premixing fuel and air prior to burning the fuel in a combustor. In particular the invention is a fuel injector and a method of mixing that promote clean combustion while safeguarding fuel injector and combustor durability.

BACKGROUND OF THE INVENTION

Combustion of fossil fuels produces a number of undesirable pollutants including nitrous oxides (NOx). Environmental degradation attributable to NOx has become a matter of increasing concern, and therefore there is intense interest in suppressing NOx formation in fuel burning devices.

One of the principal strategies for inhibiting NOx formation is to burn a fuel-air mixture that is both stoichiometrically lean and thoroughly blended. Lean stoichiometry and thorough blending keep the combustion flame temperature uniformly low—a prerequisite for inhibiting NOx formation. One type of fuel injector that produces a lean, thoroughly blended fuel-air mixture is a tangential entry injector. Examples of tangential entry fuel injectors for gas turbine engines are provided in U.S. Pat. Nos. 5,307,634, 5,402,633, 5,461,865 and 5,479,773, all of which are assigned to the assignee of the present application. These fuel injectors have a mixing chamber radially outwardly bounded by a pair of cylindrical-arc, offset scrolls. Adjacent ends of the scrolls define air admission slots for admitting air tangentially into the mixing chamber. A linear array of equidistantly spaced fuel injection passages extends along the length of each slot. A fuel injector centerbody extends aftwardly from the forward end of the injector to define the radially inner boundary of the mixing chamber. The centerbody may include provisions for introducing additional fuel, or a fuel-air mixture, into the mixing chamber. During engine operation, combustion air enters the mixing chamber tangentially through the air admission slots while equal quantities of fuel are injected into the air stream through each of the equidistantly spaced fuel injection passages. The fuel and air swirl around the centerbody and become intimately intermixed in the mixing chamber. The fuel-air mixture flows longitudinally aftwardly and is discharged into an engine combustor where the mixture is ignited and burned. The intimate premixing of the fuel and air in the mixing chamber inhibits NOx formation by ensuring a uniformly low combustion flame temperature.

Despite the many merits of the tangential entry injectors referred to above, they are not without shortcomings that may render them unsatisfactory for some applications. One shortcoming is that the fuel mixture in the mixing chamber can encourage the combustion flame to migrate into the mixing chamber where the flame can quickly damage the scrolls and centerbody. A second shortcoming is related to the flame's tendency to be spatially unstable even if it remains outside the mixing chamber. The spatial instability is manifested by fluctuations in the position of the flame and accompanying, low frequency acoustic (i.e. pressure) oscillations. Although the acoustic oscillations may not be auditorially objectionable, their repetitive character can stress the combustion chamber and reduce its useful life. The injectors referred to above are ineffective at stabilizing the combustion flame and therefore may contribute to poor combustor durability.

The problem of flame ingestion into the mixing chamber can be mitigated by a uniquely contoured centerbody as described in copending, commonly owned patent applications Ser. No. 08/771,408 and Ser. No. 08/771,409, both filed on Dec. 20, 1996. The disclosed centerbody is aerodynamically contoured so that the fuel-air mixture flows longitudinally at a velocity high enough to resist flame ingestion and promote disgorgement of any flame that is ingested. Unfortunately, these desirable characteristics of the contoured centerbody can be impaired by the low velocity of fluid in the boundary layer adhering to the centerbody. This is particularly true if the slowly moving boundary layer fluid includes fuel as well as air. Moreover it has been determined that the contoured centerbody affects the fluid flow field within the mixing chamber in a way that disturbs the uniformity of the fuel-air mixture discharged into the combustor. As a result, the potentially damaging spatial instability of the combustion flame is exacerbated and the injector's full potential for inhibiting NOx formation may be compromised.

What is needed is a premixing fuel injector that inhibits NOx formation, spatially stabilizes the combustion flame outside the injector, effectively resists flame ingestion, and reliably disgorges any flame that migrates into the interior of the injector.

SUMMARY OF THE INVENTION

It is, therefore, an object of the invention to provide a tangential entry premixing fuel injector, and a corresponding method of fuel-air mixing, that inhibits NOx formation, spatially stabilizes the combustion flame, resists flame ingestion and promotes reliable flame disgorgement.

It is a further object to provide an injector whose physical features operate in harmony so that advantages attributable to the features are not offset by accompanying disadvantages or compromised by any of the other features.

According to the invention a premixing fuel injector includes an array of fuel injection passages for injecting primary fuel nonuniformly along the length of a tangential air entry slot, and a flame disgorging, flame stabilizing centerbody that features a bluff tip aligned with the injector's discharge plane and that has discharge openings for discharging a combustible fluid into the combustor at the injector discharge plane. The combustible fluid may be a secondary fuel, preferably gaseous fuel, or may be a mixture of secondary fuel and secondary air.

In one embodiment of the fuel injector, the primary fuel passage array includes passages of at least two different classes, with each passage class being distinguished from the other passage classes by its capacity for injecting fuel. The passages are distributed along the length of the entry slot so that the distribution of passage classes is substantially periodic. In one detailed embodiment the passage classes are selected, and the passages are distributed so that primary fuel does not penetrate into the slowly moving boundary layer adhering to the centerbody.

The bluff centerbody tip, aligned with the discharge plane and having openings for discharging secondary fuel or fuel and air, anchors the combustion flame at the fuel injector discharge plane so that the combustion flame remains outside the injector where it is unlikely to damage the centerbody or scrolls. The anchoring capability of the bluff centerbody also spatially stabilizes the flame to suppress acoustic oscillations. The longitudinally nonuniform injection of primary fuel compensates for the tendency of the uniquely contoured, flame disgorging centerbody to disturb the uniformity of the fuel-air mixture discharged into the combustor. Accordingly, the selection and distribution of passage classes augments the acoustic suppression afforded by the bluff centerbody tip, helps to suppress NOx formation and, by preventing fuel penetration into the centerbody boundary layer, enhances the fuel injector's flame ingestion resistance and disgorgement capability.

One advantage attributable to the disclosed fuel injector and method of fuel-air mixing is improved fuel injector durability due to improved flame ingestion resistance and flame disgorgement capability. Another advantage is improved combustor durability due to suppressed acoustic oscillations.

The foregoing features and advantages and the operation of the invention will become more apparent in light of the following description of the best mode for carrying out the invention and the accompanying drawings.

BEST MODE FOR CARRYING OUT THE INVENTION

Figure 1:
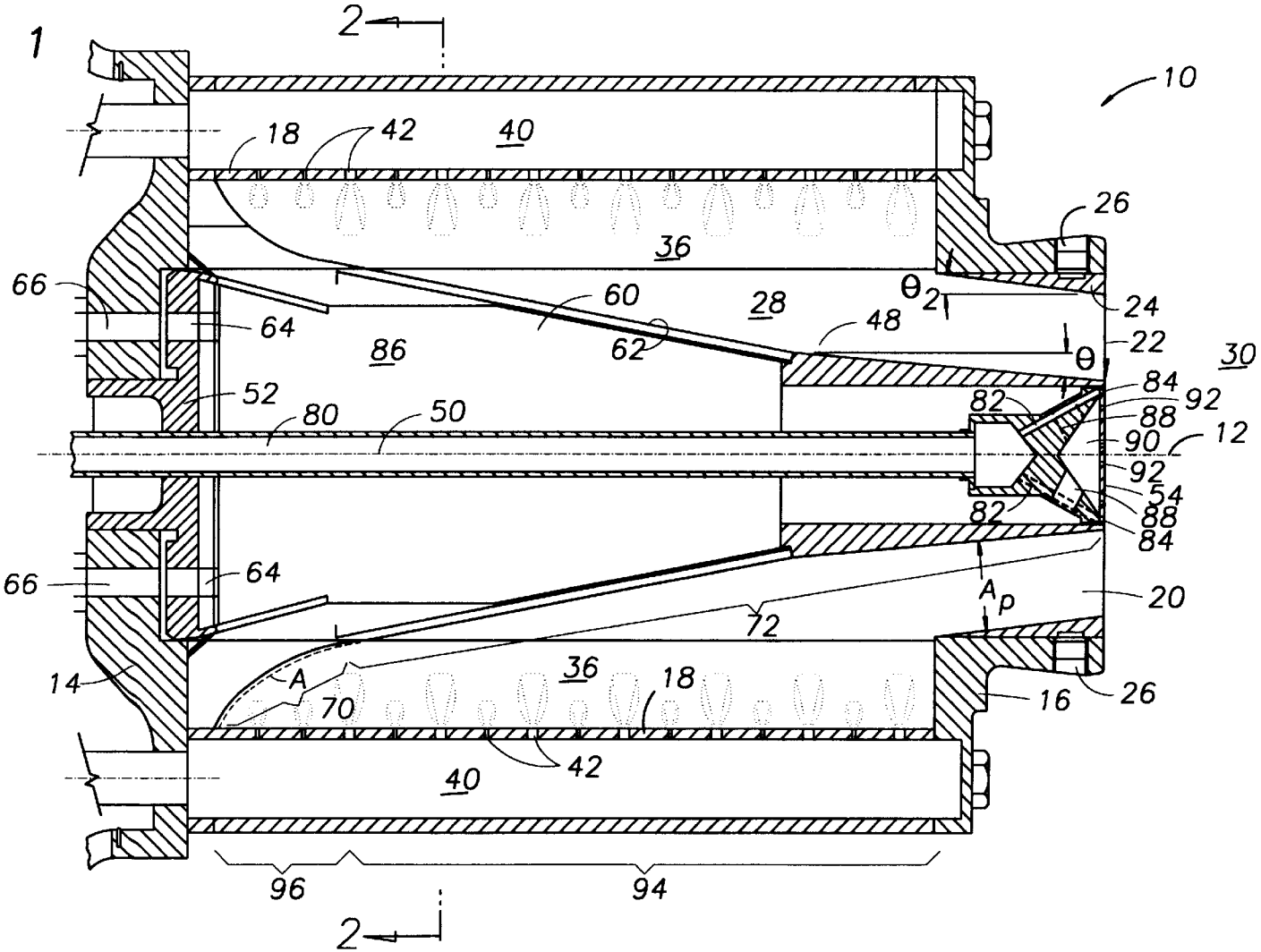
FIG. 1 is a cross sectional side view of a fuel injector of the present invention.
Figure 2:
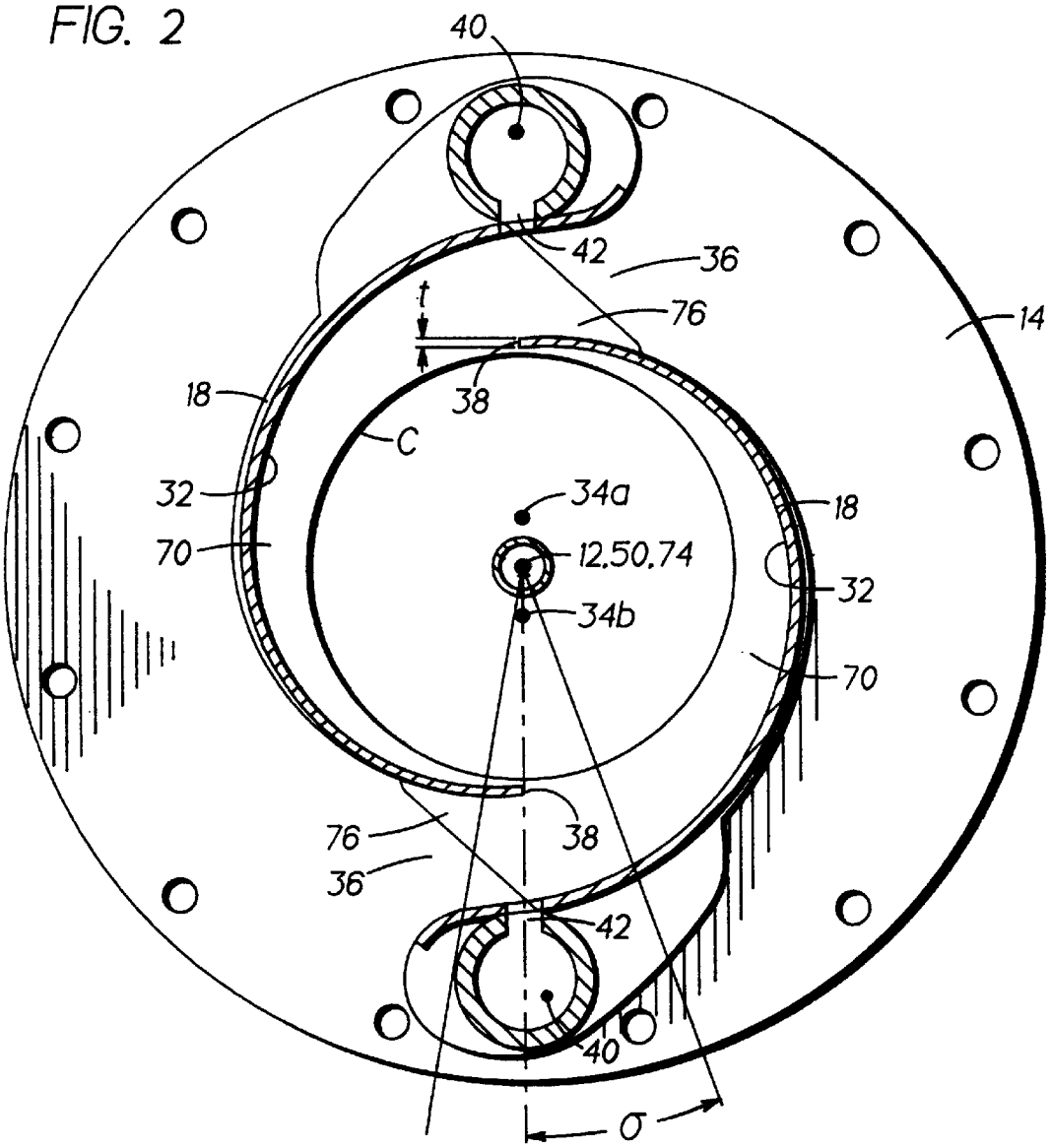
FIG. 2 is a view in the direction 2—2 of FIG. 1.
Figure 3:
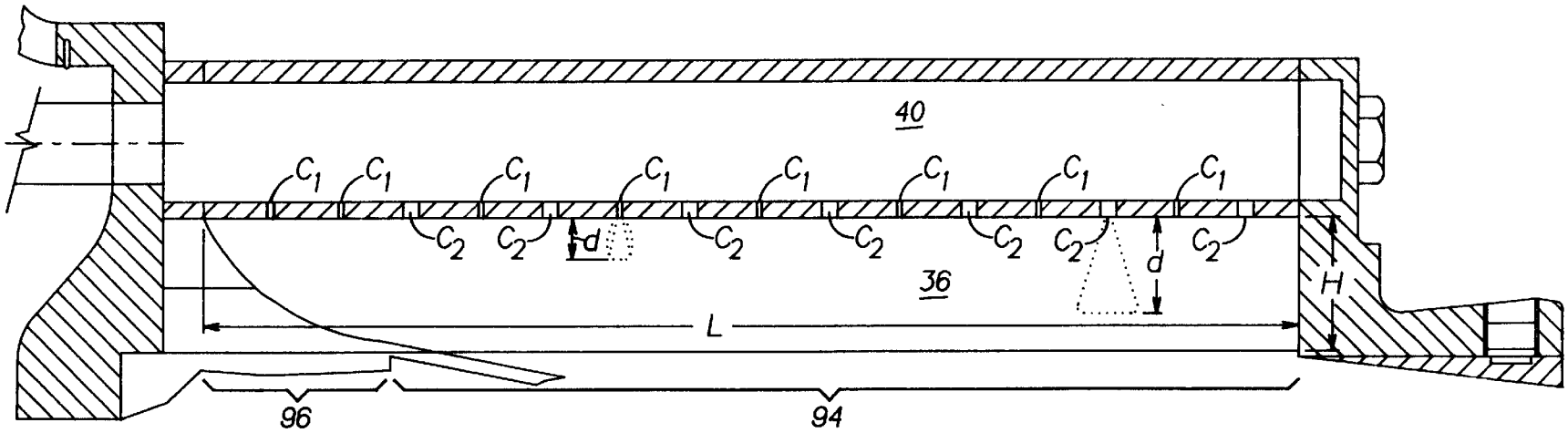
FIG. 3 is an enlarged view of a portion of FIG. 1 showing an array of fuel injection passages adjacent to a tangential air entry slot.

Referring to FIGS. 1–3, a premixing fuel injector 10 having a longitudinally extending fuel injector axis 12 includes a forward endplate 14 an aft endplate 16, and at least two cylindrical-arc scrolls 18 extending longitudinally between the endplates. A fuel injector discharge port 20 extends through the aft endplate, and the aft extremity of the discharge port defines a fuel injector discharge plane 22. The outer periphery of the port 20 is defined by a tapered insert 24 that is secured to the aft endplate by locking pins 26. The scrolls and endplates bound a mixing chamber 28 that extends longitudinally to the discharge plane and within which fuel and air are premixed prior to being burned in a combustor 30 aft of the discharge plane 22.

The scrolls 18 are spaced uniformly about the fuel injector axis 12, and each scroll has a radially inner surface 32 that faces the fuel injector axis. Each inner surface is a surface of partial revolution about a respective scroll centerline 34*a*, 34*b* situated within the mixing chamber. As used herein, the phrase "surface of partial revolution" means a surface generated by rotating a line less than one complete revolution about one of the centerlines 34*a*, 34*b*. The scroll centerlines are parallel to and equidistantly offset from the fuel injector axis so that each adjacent pair of scrolls defines an entry slot 36 parallel to the injector axis for admitting a stream of primary combustion air into the mixing chamber. The entry slot extends radially from the sharp edge 38 of a scroll to the inner surface 32 of the adjacent scroll. Each sharp edge has a thickness t that is sufficiently thin to discourage flame from becoming attached to the edge. A typical thickness is about 0.020 to 0.040 inches.

At least one and preferably all of the scrolls include a fuel supply manifold 40 and a longitudinally distributed array of substantially radially oriented fuel injection passages 42 for injecting a primary fuel (preferably a gaseous fuel) into the primary combustion air stream as it flows into the mixing chamber. To maximize the time available for fuel and air mixing, the passage array is adjacent to the entry slot. Preferably, the passage array is circumferentially aligned with the sharp edge 38 of the opposite scroll, but may be offset by an angle a. The offset angle as may be as much as 10° away from the mixing chamber (clockwise as seen in FIG. 2) or 20° toward the mixing chamber (counterclockwise as seen in FIG. 2).

The fuel injector also includes a centerbody 48 that extends aftwardly from the forward end plate. The centerbody has an axis 50, a base 52, a tip 54 and a shell 60 whose radially outer surface 62 extends from the base to the tip. The centerbody is coaxial with the fuel injector axis so that surface 62 defines a radially inner boundary of the mixing chamber 28. The base 52 includes a series of secondary air supply ports 64 each of which is circumferentially aligned with a passageway 66 in the forward end plate so that secondary air can flow into the interior of the centerbody. The tip 54 of the centerbody is bluff, i.e. it is broad and has a flat or gently rounded face. The tip is substantially longitudinally aligned with the discharge plane 22.

The radially outer surface 62 of the centerbody shell 60 includes a curved portion 70 that extends aftwardly from the base 52, and a frustum portion 72 that extends from the curved portion toward the tip. The frustum portion may be a compound frustum as illustrated in FIG. 1. Frustum angle $\theta_1$ and insert angle $\theta_2$ are chosen so that the annular cross sectional area Ap of the discharge port 20 decreases, or at least does not increase, in the aft direction to prevent fluid separation from the insert 24 or the frustum 72. The curved portion of the centerbody surface is preferably a surface generated by rotating a circular arc A, which is tangent to the frustum portion 72 and has a center which lies radially outwardly of the frustum, about the centerbody axis 50.

The forward end of the frustum portion 72 fits within a circle C (FIG. 2) inscribed in the mixing chamber 28 and having its center 74 on the fuel injector axis 12. However since the mixing chamber is not circular in cross section, the curved portion 70, which is radially larger than the frustum, must be trimmed to fit within the chamber. Portions of the centerbody therefore project into each entry slot 36, and these portions are machined to form aerodynamically shaped ramps 76. The ramps direct the fluid entering the slots 36 in the vicinity of the centerbody base 52 away from the base and onto the centerbody curved portion 70 within the mixing chamber 28.

A secondary fuel conduit 80 extends longitudinally through the centerbody and terminates in a series of branch conduits 82, each leading to a fuel discharge opening 84 in the centerbody tip for injecting a secondary combustible fluid into the combustor 30. The combustible fluid may be liquid or gaseous fuel or, in the alternative embodiment described below, may be a mixture of fuel and air. In the preferred embodiment the combustible fluid is gaseous fuel. The centerbody also includes a secondary air tube 86 that circumscribes the fuel conduit 80 and receives a continuous supply of secondary combustion air through the passageways 66 and air supply ports 64. One or more internal air conduits 88, circumferentially offset from the branch fuel conduits 82, connect the air tube to a tip cavity 90. A plurality of air discharge openings 92 extend from the cavity through the bluff tip so that the secondary air can be discharged into the combustor.

Figure 4:
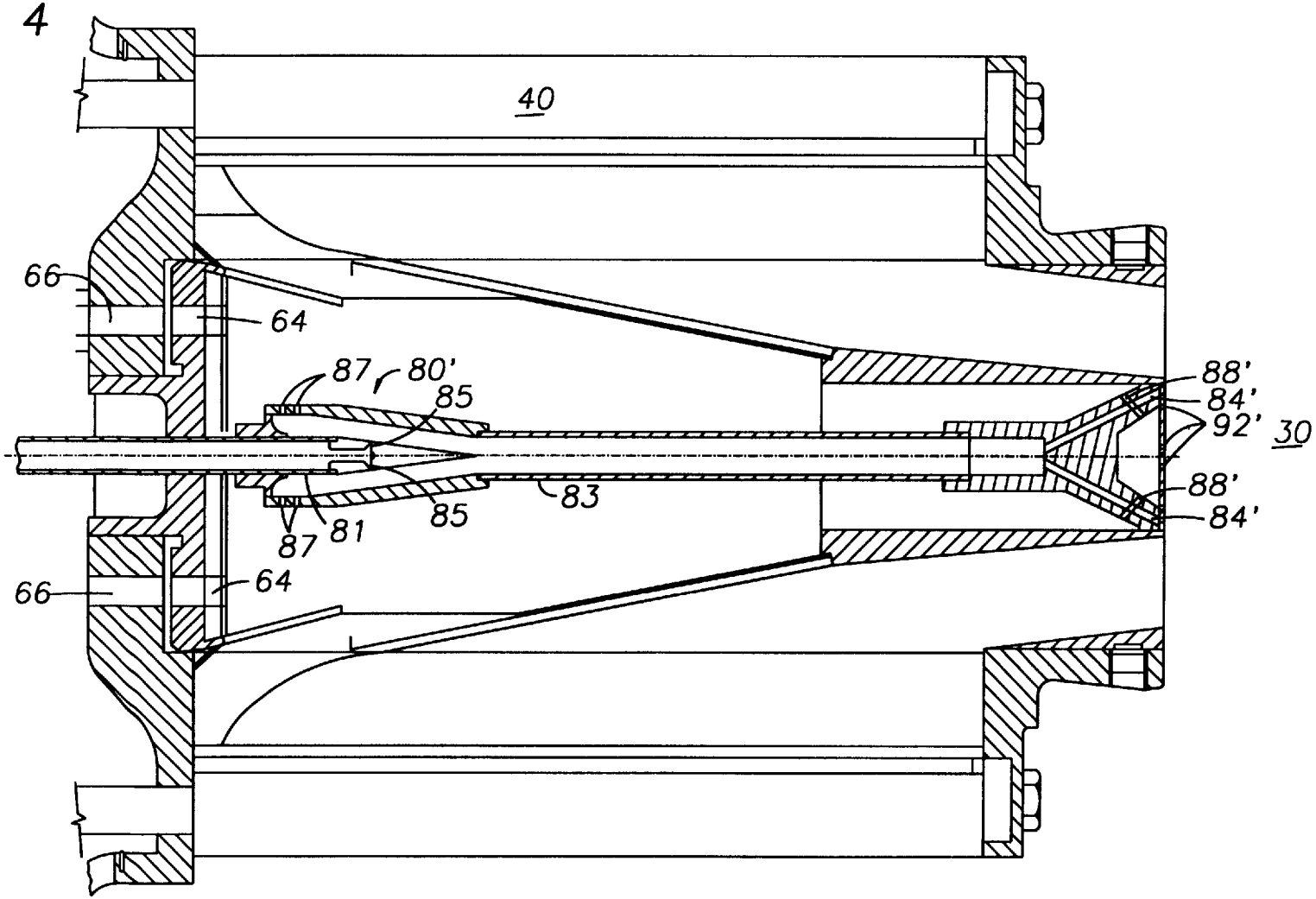
FIG. 4 is a view showing a centerbody similar to that of FIG. 1 but having provisions for introducing secondary air into a secondary fuel conduit.

In an alternative embodiment of the centerbody, seen in FIG. 4, secondary fuel conduit 80' includes a fuel lance 81 that projects into a stem 83. The fuel lance includes a series of fuel delivery orifices 85 and the stem includes a set of air inlets 87 for admitting most of the secondary air into the interior of the stem. Fuel supplied through the fuel lance and air entering through the inlets intermix within the stem so that the combustible fluid discharged through openings 84' is a mixture of secondary fuel and secondary air. In order to cool the tip, a fraction of the secondary air flows through internal air conduits 88' and air discharge openings 92'.

The array of primary fuel injection passages is configured to inject the primary fuel nonuniformly along the length L of the entry slot. To achieve longitudinally nonuniform fuel injection, the passage array comprises passages of at least two different classes. Each class is distinguished from the other classes by its capacity for injecting primary fuel into the primary combustion air stream. For example, the classes may be distinguished by the cross sectional flow metering area of the passages. Another way the passage classes may be distinguished is by a fuel penetration depth which, as seen best in FIG. 3, is the radial depth d that fuel injected through the passages penetrates into the tangentially entering primary air stream. Differences in fuel penetration depth may be achieved by using passages having different cross sectional flow areas, in which case the flow area and penetration depth distinctions are interchangeable. Different fuel penetration depths may also be achieved in other ways, for example by using equal area passages connected to fuel supplies having different pressures.

Passages belonging to different classes are distributed along the length L of the entry slot 36 to inject the primary fuel nonuniformly along the length of the slot. One possible distribution of passage classes is one that is substantially periodic over at least a portion of the length of the entry slot. In the event that only two passage classes are employed, the distribution of classes may be bipolar over at least a portion of the entry slot. As used herein, "bipolar" means a dual-class distribution in which each passage is neighbored by a passage of either the same class or of the opposite class. The bipolar distribution may be periodic or a periodic. One specific bipolar distribution is an alternating distribution in which each passage is neighbored by passages of the opposite class. Specific examples of periodic, bipolar and alternating passage class distributions are shown below, with the different passage classes being designated by the letters "A", "B" and "C":

Periodic (three classes) A-B-C-A-B-C-A-B-C-A-B-C-A-B-C; or

A-B-C-B-A-B-C-B-A-B-C-B-A-B-C;

Bipolar (a periodic) A-A-B-B-B-A-A-B-A-B-B-A-A-A-A;

Bipolar (periodic) A-A-A-B-B-B-A-A-A-B-B-B-A-A-A;

Alternating A-B-A-B-A-B-A-B-A-B-A-B-A-B-A.

By employing a multi-class passage array that injects fuel nonuniformly along the length of the entry slot 36, the spatial uniformity of the primary fuel-air mixture discharged from the fuel injector can be adjusted. Therefore, desirable features such as the flame disgorging centerbody described above, and in copending applications Ser. No. 08/771,408 and Ser. No. 08/771,409, can be used and any accompanying, undesirable disturbance of the fluid flow field within the mixing chamber can be ameliorated by nonuniformly injecting the primary fuel along the length of the entry slots.

In the illustrated fuel injector, the passages classes are distinguished by either fuel penetration depth d or, correspondingly, by flow metering area since the differences in penetration depth are achieved by using passages having different cross sectional flow areas. The passages are longitudinally distributed so that the distribution of passage classes is substantially periodic along an aft section 94 of the entry slot (i.e. the portion of the entry slot that is longitudinally coextensive with at least part of the centerbody frustum 72). More specifically, the illustrated injector uses two classes of passages. One class $c_1$ is distinguished by a small flow metering area and a shallow fuel penetration depth while the other class $c_2$ is distinguished by a large flow metering area and a deep fuel penetration depth. Each of the eight class $c_1$ passages injects about 3.4% of the primary fuel and each of the seven class $c_2$ passages injects about 10.4% of the primary fuel. The distribution of passage classes along the aft section of the entry slot is a bipolar distribution and, more specifically, an alternating distribution.

The passage classes are selected and distributed not only to improve the spatial uniformity of the fuel-air mixture discharged from the fuel injector, but also to preclude primary fuel from penetrating into the fluid boundary layer adhering to the centerbody. Preventing fuel penetration into the slowly moving boundary layer improves the fuel injector's resistance to flame ingestion and facilitates its ability to disgorge any flame that is ingested. In general, the maximum fuel penetration depth of the passage array is shallow enough to prevent primary fuel from penetrating into the fluid boundary layer adhering to the centerbody. Primary fuel is most likely to penetrate into the boundary layer along the curved portion 70 of the centerbody, rather than along the frustum portion 72, because the curved portion is radially closer to the fuel injection passages. Therefore, passages having the largest flow metering area and deepest penetration depth are excluded along a forward section 96 of the entry slot (i.e. the portion of the entry slot that is longitudinally coextensive with the curved portion 70 of the centerbody). Accordingly, for the specific dual class embodiment shown, only passages belonging to the small area/shallow penetration depth class $c_1$ are distributed along the forward section 96 of the entry slot 36.

To achieve thorough fluid mixing and prevent fuel penetration into the centerbody boundary layer, the penetration depth d of the primary fuel is at least 30% but no more than 80% of the entry slot height H and more preferably at least 40% but no more than 70% of the slot height. However, if fuel penetration is concentrated in the range of 45% to 60% of the passage height, the uniformity of the fuel-air mixture discharged from the injector has been found to be acceptable, but suboptimum. Accordingly, the recommended minimum fuel penetration depth is at least 40% but no more than 45% of the slot height and the recommended maximum fuel penetration depth is at least 60% but no more than 70% of the slot height.

In operation, primary combustion air from the compressor of the gas turbine engine enters the mixing chamber 28 through the entry slots 36. Primary fuel is injected nonuniformly along the length of the entry slot through the injection passages 42 and begins mixing with the primary combustion air. The fuel-air mixture immediately adjacent to the centerbody base 52 is directed by the ramps 76 onto the curved portion 70 of the centerbody within the mixing chamber 28 of the injector. The curved portion serves as a smooth transitional surface that redirects the tangentially entering mixture longitudinally toward the frustum 72. Due to the shape of the scrolls 18, the primary fuel-air mixture forms an annular stream that swirls around the centerbody 48, so that the fuel and air continue to mix as the annular stream progresses longitudinally toward the fuel injector discharge port 20. Due to the shape of the centerbody, the longitudinal velocity of the annular fuel-air stream remains high enough to prevent the combustor flame from migrating into the mixing chamber 28 and attaching to the outer surface 62 of the centerbody.

Meanwhile, in the embodiment of FIG. 1, secondary fuel is supplied through fuel conduit 80 and exits the fuel injector through the fuel openings 84 in the bluff centerbody tip. Air from the engine compressor flows through the passageways 66 and the air supply ports 64, and into the secondary air tube 86. The secondary air exits the fuel injector through the air discharge openings 92 in the bluff centerbody tip. In the alternative embodiment of FIG. 4, secondary fuel from the fuel lance 81 enters the stem portion 83 of fuel conduit 80' while secondary air enters the stem through inlets 87. The fuel and air mix within the stem so that a fuel-air mixture is discharged through openings 84'. A fraction of the secondary air flows through internal air conduits 88' and air discharge openings 92'. In either embodiment the centerbody tip is bluff and so, by definition, is capable of anchoring the combustion flame. The introduction of fuel and air through the openings in the bluff tip encourages the flame to become anchored to the tip. Since the bluff tip is substantially longitudinally aligned with the injector discharge plane, combustion occurs aft of the discharge plane, and most preferably in a flame anchored substantially at the discharge plane rather than in the interior of the injector where the flame would rapidly damage the injector. The spatial stability of the anchored flame contributes appreciably to improved combustor acoustics.

The present invention increases the useful life of the centerbody 48 by significantly increasing the axial velocity of the fuel-air mixture swirling about the centerbody and ensuring that fuel does not enter the slowly moving centerbody boundary layer. The increased axial velocity results from the curved portion 70, which prevents air that enters the mixing chamber 28 through the entry slots 36 immediately adjacent the base 52 from recirculating with little or no longitudinal velocity, and from the frustum portion 70, which maintains the longitudinal velocity of the annular stream at speeds which prevent attachment of a flame to the centerbody 48, and tend to disgorge the flame if it does attach to the centerbody. The flame disgorgement capability and ingestion resistance are reinforced by the selection and distribution of fuel injection passage classes to prevent fuel penetration into the centerbody boundary layer.

Improvements in injector life are also attributable to the bluff centerbody longitudinally aligned with the discharge plane 22 and having fuel discharge openings to discharge fuel into the combustor. The bluff centerbody serves as a surface capable of anchoring the flame so that combustion occurs outside, rather than inside the injector. The bluff centerbody also enhances combustor durability by encouraging the flame to become anchored to the tip so that combustor acoustic oscillations are reduced. Combustor durability is also enhanced by longitudinally nonuniform injection of primary fuel which improves the uniformity of the primary fuel-air mixture discharged through the injector discharge port and therefore contributes to flame stability and attenuated acoustic oscillations.

Although this invention has been shown and described with reference to a detailed embodiment, it will be understood by those skilled in the art that various changes in form and detail may be made without departing from the invention as set forth in the accompanying claims.

We claim:

1. A fuel injector for a gas turbine engine combustor, comprising:

a forward endplate and an aft endplate longitudinally spaced from the forward end plate, the aft endplate having a fuel injector discharge port extending therethrough, the discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot having a length and a height and extending parallel to the axis for admitting a stream of primary combustion air into the mixing chamber, at least one of the scrolls including a longitudinally distributed array of fuel injection passages adjacent to the entry slot for injecting a primary fuel into the primary combustion air stream, the passage array being configured to inject the primary fuel nonuniformly along the length of the entry slot and comprising passages of at least two different classes, each class being distinguished by its capacity for injecting fuel into the primary combustion air stream, the passages being distributed along the length of the entry slot so that the distribution of passage classes, over at least portion of the length of the entry slot, is selected from the group consisting of substantially periodic distributions and bipolar distributions; and a centerbody having a longitudinally extending shell with a radially outer surface, the centerbody being coaxial with the fuel injector axis and defining a radially inner boundary of the mixing chamber.

2. The fuel injector of claim 1 wherein the bipolar distribution of passage classes is alternating over at least a portion of the length of the entry slot.

3. The fuel injector of claim 1 or 2 wherein each passage has a fluid flow metering area and the classes are distinguished by the metering area.

4. The fuel injector of claim 1 or 2 wherein the primary fuel injected through each fuel injection passage has a fuel penetration depth into the primary air stream, and the passage classes are distinguished by the penetration depth.

5. The fuel injector of claim 4 wherein the minimum fuel penetration depth of the passage array is at least about 30% and more preferably at least about 40% of the entry slot height and the maximum penetration depth is no more than about 80% and preferably no more than about 70% of the entry slot height.

6. The fuel injector of claim 4 wherein the minimum fuel penetration depth of the passage array is at least about 40% and no more than about 45% of the entry slot height and the maximum penetration depth is at least about 60% and no more than about 70% of the entry slot height.

7. A fuel injector for a gas turbine engine combustor, comprising:

a forward endplate and an aft endplate longitudinally spaced from the forward end plate, the aft endplate having a fuel injector discharge port extending therethrough, the discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot having a length and extending parallel to the axis for admitting a stream of primary combustion air into the mixing chamber, at least one of the scrolls including a longitudinally distributed array of fuel injection passages adjacent to the entry slot for injecting a primary fuel into the primary combustion air stream, the passage array being configured to inject the primary fuel nonuniformly along the length of the entry slot and comprising passages of at least two different classes, each class being distinguished by its capacity for injecting fuel into the primary combustion air stream, the passages being distributed along the length of the entry slot so that the distribution of passage classes, over at least a portion of the length of the entry slot, is selected from the group consisting of substantially periodic distributions and bipolar distributions; and a centerbody having a longitudinally extending centerbody axis, a base, a bluff tip and a shell with a radially outer surface that extends longitudinally from the base to the tip, the centerbody being coaxial with the fuel injector axis and defining a radially inner boundary of the mixing chamber, the tip being substantially longitudinally aligned with the discharge plane, the centerbody having a fuel conduit extending therethrough and in communication with at least one fuel discharge opening in the tip for injecting a combustible fluid into the combustor.

8. A fuel injector for a gas turbine engine combustor, comprising:

a forward endplate and an aft endplate longitudinally spaced from the forward end plate, the aft endplate having a fuel injector discharge port extending therethrough, the discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot parallel to the axis for admitting a stream of primary combustion air into the mixing chamber, at least one of the scrolls including a longitudinally distributed array of fuel injection passages adjacent to the entry slot for injecting a primary fuel into the primary combustion air stream, the passage array being configured to inject the primary fuel nonuniformly along the length of the entry slot and comprising passages of at least two different classes, each class being distinguished by its capacity for injecting fuel into the primary combustion air stream, the passages being distributed along the length of the entry slot so that the distribution of passage classes, over at least a portion of the length of the entry slot, is selected from the group consisting of substantially periodic distributions and bipolar distributions; and a centerbody having a longitudinally extending centerbody axis, a base, a bluff tip and a shell having a radially outer surface that extends longitudinally from the base to the tip, the shell surface comprising a curved portion that extends aftwardly from the base and a frustum portion that extends aftwardly from the curved portion toward the tip, the centerbody being coaxial with the fuel injector axis and defining a radially inner boundary of the mixing chamber, the tip being substantially longitudinally aligned with the discharge plane, the centerbody having a fuel conduit extending therethrough and in communication with at least one fuel discharge opening in the tip for injecting a combustible fluid into the combustor.

9. A fuel injector for a gas turbine engine combustor, comprising:

a forward endplate and an aft endplate longitudinally spaced from the forward end plate, the aft endplate having a fuel injector discharge port extending therethrough, the discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot having a length and a height and extending parallel to the axis for admitting a stream of primary combustion air into the mixing chamber, at least one of the scrolls including a longitudinally distributed array of fuel injection passages, each having a fluid flow metering area, for injecting a primary fuel into the primary combustion air stream, the passage array being configured to inject the primary fuel nonuniformly along the length of the entry slot; and a centerbody having a longitudinally extending centerbody axis, a base, a tip and a shell having a radially outer surface that extends longitudinally from the base to the tip, the shell surface comprising a curved portion that extends aftwardly from the base and a frustum portion that extends aftwardly from the curved portion toward the tip, the centerbody being coaxial with the fuel injector axis and defining a radially inner boundary of the mixing chamber;

wherein the entry slot has a forward section longitudinally coextensive with the curved portion of the centerbody and an aft section longitudinally coextensive with the frustum portion of the centerbody, the passage array is adjacent to the entry slot and comprises at least two classes of passages, the classes being distinguished from each other by the fluid flow metering area of the passages, and the passages are longitudinally distributed so that the distribution of passage classes is substantially periodic along the aft section of the entry slot, and so that passages belonging to the passage class having the largest metering area are excluded along the forward section of the entry slot.

10. A fuel injector for a gas turbine engine combustor, comprising:

a forward endplate and an aft endplate longitudinally spaced from the forward end plate, the aft endplate having a fuel injector discharge ort extending therethrough, the discharge port having an aft extremity that defines a fuel injector discharge plane;

at least two cylindrical-arc scrolls extending longitudinally between the forward and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot having a length and a height and extending parallel to the axis for admitting a stream of primary combustion air into the mixing chamber, at least one of the scrolls including a longitudinally distributed array of fuel injection passages, each having a fluid flow metering area, for injecting a primary fuel into the primary combustion air stream, the passage array being configured to inject the primary fuel nonuniformly along the length of the entry slot; and a centerbody having a longitudinally extending centerbody axis, a base, a tip and a shell having a radially outer surface that extends longitudinally from the base to the tip, the shell surface comprising a curved portion that extends aftwardly from the base and a frustum portion that extends aftwardly from the curved portion toward the tip, the centerbody being coaxial with the fuel injector axis and defining a radially inner boundary of the mixing chamber;

wherein the entry slot has a forward section longitudinally coextensive with the curved portion of the centerbody and an aft section longitudinally coextensive with the frustum portion of the centerbody, the passage array is adjacent to the entry slot and comprises two classes of passages, one class having a small fluid flow metering area and the other class having a large metering area, the longitudinal distribution of passage classes is bipolar along the aft section of the entry slot, and only passages of the small area class are distributed along the forward section of the entry slot.

11. The fuel injector of claim 10 wherein the distribution of passage classes is alternating along the aft section of the entry slot.

12. A fuel injector for a gas turbine engine combustor, comprising:

a forward endplate and an aft endplate longitudinally spaced from the forward end plate, the aft endplate having a fuel injector discharge port extending therethrough, the discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot having a length and a height and extending parallel to the axis for admitting a stream of combustion air into the mixing chamber, at least one of the scrolls including a longitudinally distributed array of fuel injection passages, each having a fluid flow metering area, for injecting a primary fuel into the primary combustion air stream, the passage array being configured to inject the primary fuel nonuniformly along the length of the entry slot; and a centerbody having a longitudinally extending centerbody axis, a base, a tip and a shell having a radially outer surface that extends longitudinally from the base to the tip, the shell surface comprising a curved portion that extends aftwardly from the base and a frustum portion that extends aftwardly from the curved portion toward the tip, the centerbody being coaxial with the fuel injector axis and defining a radially inner boundary of the mixing chamber;

wherein the primary fuel injected through each injection passage has a fuel penetration depth into the primary combustion air stream, the entry slot has a forward section longitudinally coextensive with the curved portion of the centerbody and an aft section longitudinally coextensive with the frustum portion of the centerbody, the passage array is adjacent to the entry slot and comprises at least two classes of passages, the classes being distinguished from each other by a fuel penetration depth and the longitudinal distribution of passage classes is substantially periodic along the aft section of the entry slot, and passages belonging to the class having the deepest penetration depth are excluded along the forward section of the entry slot.

13. A fuel injector for a gas turbine engine combustor, comprising:

a forward endplate and an aft endplate longitudinally spaced from the forward end plate, the aft endplate having a discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent lair of scrolls defines an entry slot having a length and a height and extending parallel to the axis for admitting a stream of primary combustion air into the mixing chamber, at least one of the scrolls including a longitudinally distributed array of fuel injection passages, each having a fluid flow metering area, for injecting a primary fuel into the primary combustion air stream, the passage array being configured to inject the primary fuel nonuniformly along the length of the entry slot; and a centerbody having a longitudinally extending centerbody axis, a base, a tip and a shell having a radially outer surface that extends longitudinally from the base to the tip, the shell surface comprising a curved portion that extends aftwardly from the base and a frustum portion that extends aftwardly from the curved portion toward the tip, the centerbody being coaxial with the fuel injector axis and defining a radially inner boundary of the mixing chamber;

wherein the primary fuel injected through each injection passage has a penetration depth into the primary combustion air stream, the entry slot has a forward section longitudinally coextensive with the curved portion of the centerbody and an aft section longitudinally coextensive with the frustum portion of the centerbody, the passage array is adjacent to the entry slot and comprises two classes of passages, one class having a shallow fuel penetration depth and the other class having a deep fuel penetration depth, the longitudinal distribution of passage classes is bipolar along the aft section of the entry slot, and only passages of the shallow penetration depth class are distributed along the forward section of the entry slot.

14. The fuel injector of claim 13 wherein the distribution of passage classes is alternating along the aft section of the entry slot.

15. The fuel injector of claim 12, 13 or 14 wherein the minimum fuel penetration depth of the passage array is at least about 30% and more preferably at least about 40% of the entry slot height and the maximum penetration depth is no more than about 80% and preferably no more than about 70% of the entry slot height.

16. The fuel injector of claim 12, 13 or 14 wherein the minimum fuel penetration depth of the passage array is at least about 40% and no more than about 45% of the entry slot height and the maximum penetration depth of the passage array is at least about 60% and no more than about 70% of the entry slot height.

17. The fuel injector of claim 12, 13 or 14 wherein the maximum fuel penetration depth of the passage array is shallow enough to preclude the primary fuel from entering the fluid boundary layer attached to the centerbody.

18. A fuel injector for a gas turbine engine combustor, comprising:

a forward endplate and an aft endplate longitudinally spaced from the forward end plate, the aft endplate having a fuel injector discharge port extending therethrough, the discharge port having an aft extremity that defines a fuel injector discharge plane;

at least two cylindrical-arc scrolls extending longitudinally between the forward endplate and the aft endplate and cooperating with the endplates to bound a mixing chamber, each scroll defining a surface of partial revolution about a respective scroll centerline, the scroll centerlines being parallel to and equidistantly offset from a longitudinally extending fuel injector axis so that each adjacent pair of scrolls defines an entry slot parallel to the axis for admitting a stream of primary combustion air into the mixing chamber, at least one of the scrolls including a longitudinally distributed array of fuel injection passages adjacent to the entry slot for injecting a primary fuel into the primary combustion air stream;

a centerbody having a longitudinally extending centerbody axis, a base, a bluff tip and a shell having a radially outer surface that extends longitudinally from the base to the tip, the shell surface comprising a curved portion that extends aftwardly from the base and a frustum portion that extends aftwardly from the curved portion toward the tip, the centerbody being coaxial with the fuel injector axis and defining a radially inner boundary of the mixing chamber, the tip being substantially longitudinally aligned with the discharge plane, the centerbody having a fuel conduit extending therethrough and in communication with at least one opening in the tip for injecting a combustible fluid into the combustor, the fuel injector also including a secondary air tube for admitting secondary combustion air into the interior of the centerbody and at least one air discharge opening in the centerbody tip for discharging the secondary combustion air into the combustor;

wherein the entry slot has a forward section longitudinally coextensive with the curved portion of the centerbody and an aft section longitudinally coextensive with the frustum portion of the centerbody, the passage array comprising passages having a small fluid flow metering area and other passages having a large metering area, the large and small area passages alternating along the aft section of the entry slot and having only small area passages distributed along the forward section of the entry slot.

* * * * *